US009305423B2

(12) United States Patent
Salzman et al.

(10) Patent No.: US 9,305,423 B2
(45) Date of Patent: Apr. 5, 2016

(54) UTILITY HOOK AND SENSOR ASSEMBLY FOR WAGERING GAME TERMINALS AND GAMING SYSTEMS

(71) Applicant: WMS Gaming Inc., Waukegan, IL (US)

(72) Inventors: Scot W. Salzman, Buffalo Grove, IL (US); Christopher W. Chudek, Evanston, IL (US); Evan A. Hollander, Buffalo Grove, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 284 days.

(21) Appl. No.: 13/767,199

(22) Filed: Feb. 14, 2013

(65) Prior Publication Data

US 2013/0324206 A1 Dec. 5, 2013

Related U.S. Application Data

(60) Provisional application No. 61/653,662, filed on May 31, 2012.

(51) Int. Cl.
*G07F 17/32* (2006.01)

(52) U.S. Cl.
CPC ..... *G07F 17/3216* (2013.01); *G07F 17/3206* (2013.01); *G07F 17/3241* (2013.01)

(58) Field of Classification Search
None
See application file for complete search history.

(56) References Cited

U.S. PATENT DOCUMENTS

| | | | | |
|---|---|---|---|---|
| 5,594,419 | A * | 1/1997 | Lo | 340/568.1 |
| 5,839,960 | A | 11/1998 | Parra et al. | 463/41 |
| 5,934,637 | A | 8/1999 | Robinson | 248/311.2 |
| 6,003,013 | A | 12/1999 | Boushy et al. | 705/10 |
| 6,116,547 | A | 9/2000 | Johnson et al. | 248/49 |
| 6,290,229 | B1 | 9/2001 | Perez | 273/148 R |
| 6,517,433 | B2 | 2/2003 | Loose et al. | 463/20 |
| 6,779,794 | B2 | 8/2004 | Hedrick et al. | 273/148 R |
| 7,322,554 | B2 * | 1/2008 | Caroselli et al. | 248/304 |
| 7,385,521 | B2 * | 6/2008 | Macari | 340/686.6 |
| 7,454,365 | B1 * | 11/2008 | Brosnan et al. | 705/16 |
| 7,468,665 | B2 * | 12/2008 | Grundy | 340/568.1 |
| 7,479,066 | B2 * | 1/2009 | Emori | 463/46 |
| 7,553,236 | B2 | 6/2009 | Parra et al. | 463/46 |

(Continued)

FOREIGN PATENT DOCUMENTS

| | | | |
|---|---|---|---|
| JP | 2009-125465 A | † | 6/2009 |
| JP | 2009125465 A | * | 6/2009 |

(Continued)

OTHER PUBLICATIONS

Machine Translation of JP 2009 125465 A into English.*

*Primary Examiner* — Jason Skaarup
(74) *Attorney, Agent, or Firm* — Nixon Peabody LLP

(57) ABSTRACT

Gaming terminals, gaming machines, gaming systems and utility hook and sensor assemblies are presented. A gaming terminal for playing a wagering game is disclosed. The gaming terminal includes a cabinet, at least one display device configured to display aspects of the wagering game, and at least one input device configured to receive an input from a player to play the wagering game. The gaming terminal also includes a support mechanism that is attached to the cabinet and is configured to support a personal belonging of the player. An alert system is configured to detect the presence or absence, or both, of the personal belonging and/or the player at the gaming terminal, and generate an alert signal in response to the detected presence or absence.

22 Claims, 5 Drawing Sheets

(56) References Cited

U.S. PATENT DOCUMENTS

| | | | | |
|---|---|---|---|---|
| 7,619,519 | B2 * | 11/2009 | Richter | 340/568.8 |
| 7,681,851 | B1 * | 3/2010 | Osterholt et al. | 248/308 |
| 8,011,633 | B2 * | 9/2011 | Huang | 248/308 |
| 8,308,125 | B2 * | 11/2012 | Losaw | 248/690 |
| 2004/0012146 | A1 | 1/2004 | Luciano, Jr. et al. | 273/148 R |
| 2006/0035707 | A1 * | 2/2006 | Nguyen et al. | 463/29 |
| 2006/0199648 | A1 * | 9/2006 | Mitchell et al. | 463/46 |
| 2007/0032295 | A1 * | 2/2007 | Muir | G07F 17/32 463/29 |
| 2007/0123354 | A1 * | 5/2007 | Okada | G07F 17/32 463/47 |
| 2009/0109027 | A1 * | 4/2009 | Schuller | 340/568.1 |
| 2010/0069160 | A1 | 3/2010 | Barrett et al. | 463/46 |
| 2010/0234099 | A1 | 9/2010 | Rasmussen et al. | 463/29 |
| 2012/0115586 | A1 * | 5/2012 | Okada | G07F 17/32 463/25 |
| 2014/0213340 | A1 * | 7/2014 | Michels | 463/20 |

FOREIGN PATENT DOCUMENTS

| | | | |
|---|---|---|---|
| WO | 2007/089410 | 8/2007 | A63F 9/24 |
| WO | WO 2007089410 A2 * | 8/2007 | |

* cited by examiner
† cited by third party

UTILITY HOOK AND SENSOR ASSEMBLY FOR WAGERING GAME TERMINALS AND GAMING SYSTEMS

CLAIM OF PRIORITY AND CROSS-REFERENCE TO RELATED APPLICATION

This application claims the benefit of and priority to U.S. Provisional Patent Application No. 61/653,662, which was filed on May 31, 2012, and is incorporated herein by reference in its entirety.

COPYRIGHT

A portion of the disclosure of this patent document contains material which is subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as wagering game terminals and gaming systems. More particularly, the present disclosure relates to convenience features for users of wagering game terminals and gaming systems.

BACKGROUND

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Thus, gaming manufacturers continuously strive to develop new games and improved gaming enhancements that will attract frequent play through enhanced entertainment value to the player.

Traditionally, a person who wishes to play an electronic wagering game will visit a casino or other known gaming establishment and play such wagering games on a free-standing electronic or electro-mechanical gaming terminal. With such gaming terminals, the user plays the wagering game while standing or sitting in front of the terminal, inserting coins or other forms of credit, and manipulating one or more player input devices to interact with the game. Oftentimes, a patron will stay at a single gaming terminal for several hours, attempting to build up large cumulative winnings Notwithstanding the widespread use and presence of these machines, most prior art gaming terminals fail to provide adequate, much less convenient, storage for personal effects, such as coats and purses, or resting places for food, drinks, or other items that players often have with them while patronizing a casino or gaming establishment.

With the increased popularity and profitability of casinos throughout the country, casino operators are attempting to make their establishments as "user friendly" as possible to increase patronage and, thus, maximize the profitability of the casino. In this regard, some prior art gaming terminals have been designed with convenience features, such as ash trays, cup holders, and food trays, to provide a secure and convenient place to rest a cigarette, drink, or snack while playing a game of chance in the casino. Very little attention has been paid to convenience features for patrons who wish to safely and securely stow personal valuables, such as purses, jackets, and the like. This issue is exacerbated by criminals who target players who carelessly stow their personal effects on the floor or in the space between adjacent terminals, and patrons who hang their purses and jackets on the back of a stool or chair, all of which are out of the player's immediate line of sight. Additionally, players have been known to forget purses and other personal effects after they finish playing a wagering game and leave the gaming terminal.

SUMMARY

Aspects of the present disclosure are directed to wagering game systems and, more particularly, gaming terminals with a utility hook and sensor assembly which addresses one or more of the above-mentioned deficiencies in the prior art. One aspect is directed to a cabinet for a gaming terminal with a retractable hook that projects from a lower portion of the cabinet to allow the patron to hang a handbag, coat, etc., during game play. To ensure that the patron does not forget to take their belonging(s) with them when they are done playing, the gaming terminal or system will alert the player before they leave the terminal. To that effect, the cabinet can incorporate sensors in the cabinet door, utility hook, and/or gaming chair that would detect the presence of the handbag and/or the presence of a player. These items can operate together with system software to alert the player if they leave (or are about to leave) without their belongings.

According to one aspect of the present disclosure, a gaming terminal for playing a wagering game is disclosed. The gaming terminal includes a cabinet, at least one display device that is configured to display aspects of the wagering game, and at least one input device that is configured to receive an input from a player to play the wagering game. The gaming terminal also includes a support mechanism that is attached to the cabinet and configured to support a personal belonging of the player. An alert system is configured to detect a presence or absence, or both, of at least one of the personal belonging and the player at the gaming terminal, and generate an alert signal in response to the detected presence or absence. The gaming terminals disclosed herein can include other hardware and software, as well as other peripheral componentry.

Other aspects of the present disclosure are directed to a gaming machine. The gaming machine includes a cabinet with an input device that is operatively connected to the cabinet and configured to receive an input to play a wagering game. A display device is operatively mounted to the cabinet and configured to display a randomly determined outcome of the wagering game. The gaming machine also includes a retractable hook that projects from the cabinet and is configured to support a personal belonging of a player. The gaming machine further comprises an alert system that is configured to: detect a presence or an absence, or both, of the personal belonging hanging on the hook and the player at the gaming machine; and generate an alert signal in response to a detected presence of the personal belonging and a detected absence of the player.

Another aspect of this disclosure is directed to a gaming system for playing a wagering game. The gaming system includes, inter alia, an input device, a display device, a processor, and a cabinet. A support mechanism is attached to the cabinet and configured to support a personal belonging of the player. The gaming system also includes an alert system that is configured to detect a presence or absence, or both, of at least one of the personal belonging and the player at the gaming terminal, and generate an alert signal in response to the detected presence or absence.

Yet another aspect of this disclosure presents a gaming system. The gaming system includes a processor, a cabinet, an input device that is operatively connected to the cabinet and configured to receive an input to play a wagering game, and a display device that is operatively mounted to the cabinet and configured to display a randomly determined outcome of the wagering game. The gaming system also includes a retractable hook that projects from the cabinet and is configured to support a personal belonging of a player. An alert system is configured to: detect a presence or an absence, or both, of the personal belonging hanging on the hook and the player at the gaming machine; and, generate an alert signal in response to a detected presence of the personal belonging and a detected absence of the player.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and modes for carrying out the present invention when taken in connection with the accompanying drawings and the appended claims.

Figure 1:
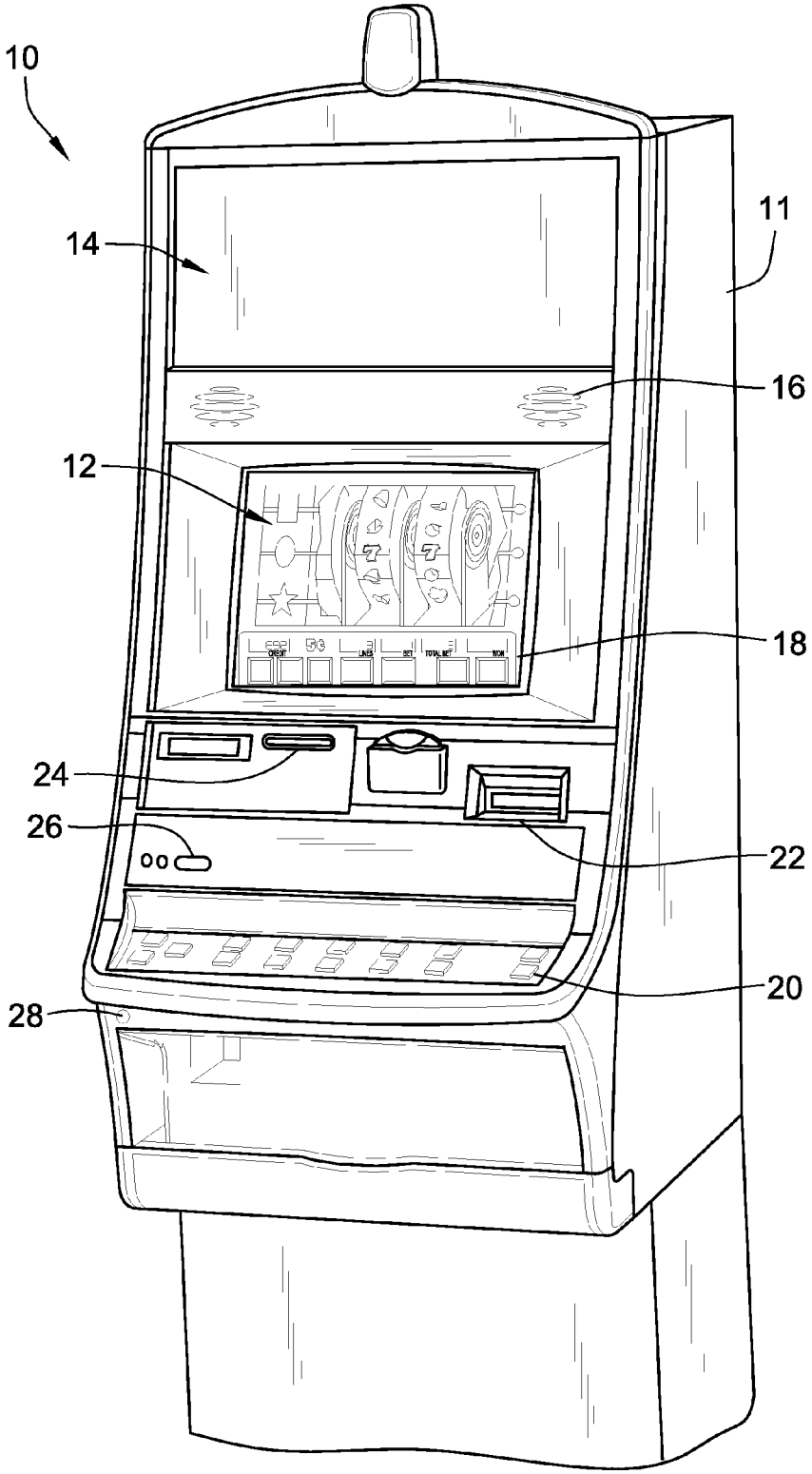
FIG. 1 is a perspective-view illustration of an exemplary free-standing gaming terminal according to aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

This invention is susceptible of embodiment in many different forms. There are shown in the drawings and will herein be described in detail representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "generally," "approximately," and the like, can be used herein in the sense of "at, near, or nearly at," or "within 3-5% of," or "within acceptable manufacturing tolerances," or any logical combination thereof, for example.

Referring to the drawings, wherein like reference numerals refer to like features throughout the several views, there is shown in FIG. 1 a representative gaming terminal 10 similar to those used in gaming establishments, such as casinos, hotels and cruise ships, and non-conventional gaming establishments, such as airports and restaurants. With regard to the present disclosure, the gaming terminal 10 may be any type of gaming terminal and may have varying structures and methods of operation. For example, in some aspects, the gaming terminal 10 is an electromechanical gaming terminal configured to play slots with mechanical reels, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models (as shown), handheld mobile devices, bartop models, workstation-type console models, etc. Further, the gaming terminal 10 may be primarily dedicated for use in conducting wagering games, or may include non-dedicated devices, such as mobile phones, personal digital assistants, personal computers, laptop computers, tablet computers, etc. Exemplary types of gaming terminals are disclosed in U.S. Pat. No. 6,517,433, U.S. Patent Application Publication Nos. 2010/0069160 and 2010/0234099, and International Application No. PCT/US2007/000792, all of which are incorporated herein by reference in their respective entireties for all purposes.

The gaming terminal 10 illustrated in FIG. 1 comprises a cabinet 11 that may house various input devices, output devices, and input/output devices. By way of non-limiting example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display may be disposed in front of the mechanical-reel display to portray a video image superimposed upon the mechanical-reel display. The display areas may variously display information associated with wagering games, non-wagering games, community games, progressive games, advertisements, services, premium entertainment, text messaging, emails, alerts, announcements, broadcast information, subscription information, etc., appropriate to the particular mode(s) of operation of the gaming terminal 10. The gaming terminal 10 includes a touch screen(s) 18 mounted over the primary and/or secondary areas 12, 14, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts. A retractable utility hook 28 projects from a front portion of the cabinet underneath the button panel 20.

Input devices, such as the touch screen 18, buttons 20, a mouse, a joystick, a gesture-sensing device, other sensing devices, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals can be selected from a group consisting essentially of an electrical current, an electrical voltage, an electrical charge, an optical signal, an optical element, a magnetic signal, and a magnetic element.

Figure 2:
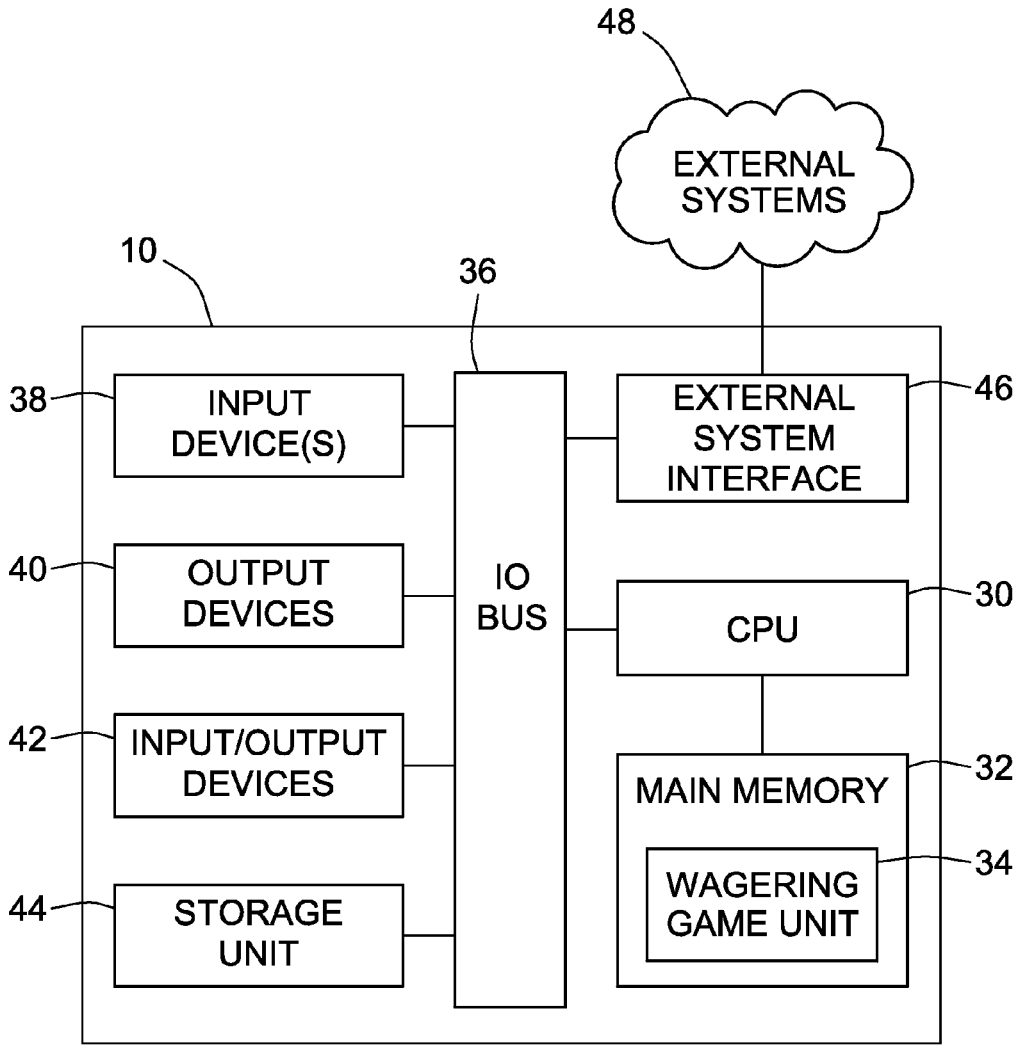
FIG. 2 is a schematic diagram of an example of a gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes a random number generator (RNG) for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
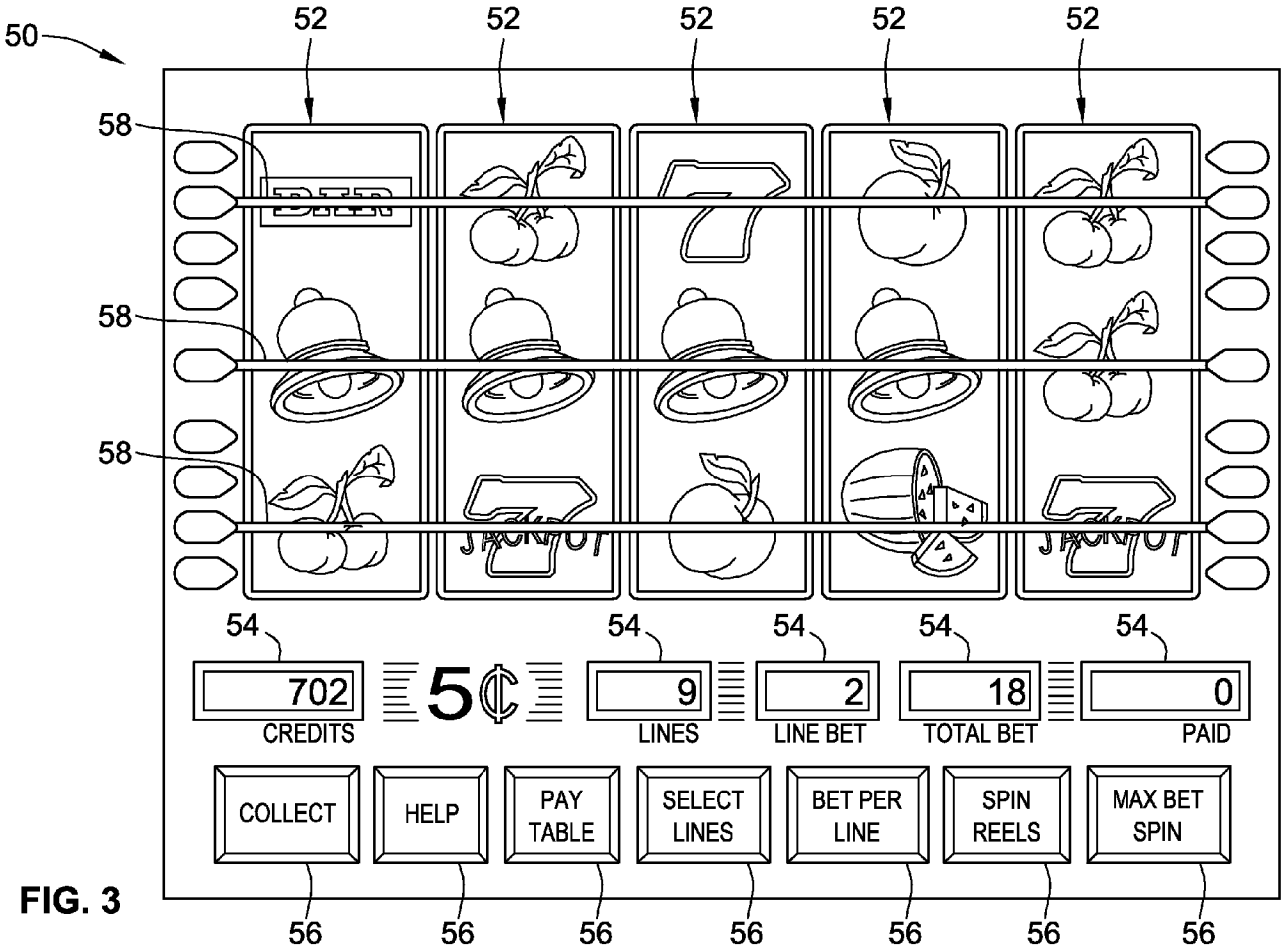
FIG. 3 is a screen shot of a representative basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by an RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
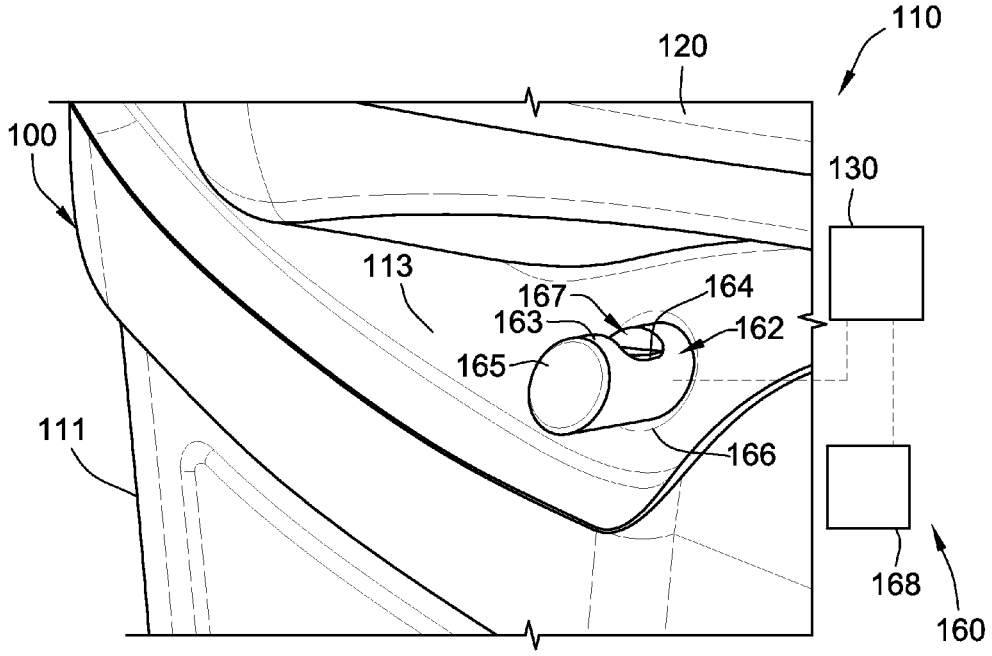
FIG. 4 is a partially schematic perspective-view illustration of a portion of representative gaming terminal with a utility hook and alert mechanism in accordance with aspects of the present disclosure.

FIG. 4 illustrates a portion of a representative gaming terminal (or "gaming machine"), generally designated as 100, which may be part of a gaming system 110. Although differing in appearance, the gaming terminal 100 and gaming system 110 of FIG. 4 can take on many of the various forms, optional configurations, and functional alternatives described above with respect to the gaming terminals and gaming systems exemplified in FIGS. 1 and 2, and thus can include any of the corresponding options and features. For instance, the gaming terminal 100 can offer the same functionality and connectivity as the gaming terminal 10 discussed above with respect to FIGS. 1 and 2. As some more specific examples, the gaming terminal 100 includes a cabinet 111 that may house various input devices, output devices, and input/output devices. The output device(s) may be in the nature of one or more display devices (e.g., primary display 12 and secondary display 14 of FIG. 1), each of which is configured to display aspects of a wagering game, as well as one or more acoustic speakers (e.g., speakers 16 of FIG. 1) to provide complementary audio content. By way of comparison, the input device(s) may be in the nature of a button panel 120 and/or a touch screen (e.g., touch screen 18 of FIG. 1), each of which configured to receive inputs from a player to play the wagering game.

To offer a more user friendly and convenient environment, the gaming terminal 100 of FIG. 4 is also provided with a support mechanism, which is represented herein by a utility hook 162, and an alert system 160, which is exemplified by one or more sensors 164 and 168 that can be communicatively coupled to a processor 130. The processor 130 of FIG. 4 may take on various forms and configurations, including those discussed above with respect to the CPU 30 of FIG. 2. In this regard, the gaming terminal 100 may communicate with an external system (e.g., external system(s) 48 of FIG. 2) such that the terminal operates as a "thin client" with the processor 130 packaged remotely, a "thick client" with the processor 130 packaged locally, or through any range of functionality therebetween. As will become more readily apparent from the following description, the support mechanism and alert system (which can be collectively referred to as a "utility hook and sensor assembly") may comprise additional and/or alternative components from the arrangement portrayed in FIG. 4.

The utility hook 162 is attached to the cabinet 100 and configured to support one or more personal belongings of the player, such as a purse, coat, backpack, sweater, laptop bag, and the like. As shown, the utility hook 162 is cantilevered by the cabinet 111, projecting generally horizontally from a forward portion of the cabinet 111 (e.g., a front surface 113 of an access door of the cabinet base) underneath the button panel 120 and, in some embodiments, above a coin chute area and/or a knee well. The utility hook 162 of FIG. 4 includes an elongated, generally cylindrical body 163 with a longitudinal end 165 that can be angled and/or contoured to coincide with the angle/contour of the front surface 113 from which it projects. With an angled/contoured end 165, retractable configurations will allow the utility hook 162 to sit flush with the surface 113 of the cabinet 111 when in a retracted position, similar to what is shown in FIG. 1 with the utility hook 28 retracted into the cabinet 11. A recessed cavity 167 is located along the upper surface of the cylindrical body 163 between the longitudinal end 165 thereof and the cabinet 111. The recessed cavity 167 is shaped and sized, in at least some embodiments, to receive and nest a multitude of different purse and bag straps, coat and sweater locker loops, etc. In that regard, it is also desirable, in at least some embodiments, to fabricate the utility hook 162 from a material of sufficient strength and resiliency to support the player's personal belongings. An optional lighting mechanism 166 may be provided to illuminate the utility hook 162 and thereby increase locatability.

Within the scope of this disclosure, the support mechanism may take on different sizes, numbers and geometric configurations from the illustrated embodiment. It is also envisioned that the support mechanism project from other locations of the cabinet 111 without departing from the scope of this disclosure. In some optional alternative embodiments, the support mechanism may include multiple utility hooks (e.g., a rack), one or more hangers, one or more pegs, one or more trays, etc. Some additional geometric and location options are provided in FIGS. 5 and 6, which will be developed in further detail below.

To prevent accidental breakage of the support mechanism and to prevent players from accidentally hitting the support mechanism while entering or alighting from a gaming chair or stool, for example, the support mechanism may be retractable, foldable or collapsible. In the embodiment illustrated in FIG. 4, the utility hook 162 is configured to selectively transition back and forth between an extended position, whereat the hook 162 projects from the cabinet 111, and a retracted position, whereat the hook 162 is stowed or otherwise disposed substantially inside the gaming cabinet 111. The utility hook 162 of FIG. 4 is configured to translate rectilinearly from the extended position to the retracted position, and back. Optional configurations of the gaming terminal 100 may include a biasing member, such as a helical spring, to push, pull or otherwise bias the utility hook 162 toward the extended position. A locking mechanism, such as a spring-biased locking tab, can be engaged to lock the utility hook 162 in the retracted position. A release mechanism, such as a release button or a release lever, may also be provided to release the locking mechanism such that the utility hook 162 is biased to the extended position via the biasing member. Optionally, the locking and release mechanisms can be part of a single device, similar to a spring-loaded twist lock device, for example.

The alert system 160 is designed to detect the presence or absence of the player's personal belonging(s) and/or the player at the gaming terminal, and generate an alert signal in response to the detected presence or absence. In some embodiments, the alert system 160: detects the presence or absence, or both, of a personal belonging hanging on the utility hook 162; detects the presence or absence, or both, of the player at the gaming terminal 100; and, generates an alert signal in response to a detected presence of the personal belonging and a detected absence of the player. The alert system 160 of FIG. 4, for example, includes two sensors: a first sensor 164 that is operable to detect the presence or absence of a personal belonging hanging on the utility hook 162, and output a signal indicative thereof; and, a second sensor 168 that is operable to detect the presence or absence of the player at the gaming terminal, and output a signal indicative thereof. In the illustrated embodiment, the first sensor 164 is a pressure transducer that is housed within the utility hook 162 and operable to generate a signal responsive of pressure imposed on the utility hook 162 via the personal belonging. By way of comparison, the second sensor 168 is an optical transducer that is housed within the cabinet 111 and operable to generate a signal responsive to a physical obstruction (e.g., a portion of the player's body) in front of the gaming terminal 100. The sensors 164, 168 may take on alternative forms and can be packaged in alternate locations. For example, the sensors 164, 168 can each take on numerous forms of sensing devices, including, for example, acoustic sensing devices, such as ultrasonic sensors, thermal sensing devices, such as infrared sensors, optical sensing devices, such as light-based and laser-based sensors, capacitive sensing devices, such as capacitive-based proximity sensors, etc. Moreover, the first sensor 164 can be packaged inside the cabinet 111 (e.g., on the underside of the button panel 120) and the second sensor 168 can be packaged in a gaming chair or a mat upon which the player sits or stands while playing at the gaming terminal 100.

In some optional arrangements, the alert system 160 can omit one or more of the sensors 164, 168. For example, the alert system 160 need not monitor the player's physical presence at the gaming terminal 100, but rather can determine from other indicators that the player has left or intends to leave the gaming terminal 100. As some non-limiting examples, the alert system 160 can generate an alert signal if a personal belonging is detected when the player "cashes out," or when the player removes a player card from the gaming terminal, or after a predetermined lapse of time without any player inputs, or when the player depletes all of their gaming credits, or any combination thereof, etc. In this optional arrangement, the alert system 160 can omit the second sensor 168.

To ensure that a player does not forget their belonging(s) when they are done playing, the gaming terminal 100 will alert the player, e.g., before, during and/or after they leave the terminal. Responsive to the alert signal generated by the alert system 160, the controller 130 can generate various outputs from the gaming terminal 100. For example, the display device(s) may be configured to display a visual alert in response to the alert signal generated by the alert system 160. The visual alert may be a picture of a stop sign or other well-known sign, symbol or indicia of warning, which may be accompanied (or replaced) by a textual notification. In addition, or as an optional alternative, the speaker(s) may be configured to generate an audible alert (e.g., "STOP! You forgot something!") in response to the alert signal generated by the alert system 160. As another option or alternative, the processor 130 may, in response to the alert signal, transmit an electronic notification or warning message to the player or an attendant or other personnel of the gaming establishment. The technology used for this alert may include, for example, a web push, text, email etc.

The alert systems disclosed herein can benefit players by reducing or eliminating the potential for losing their personal items after playing a wagering game. The alert systems can also help to reduce the possibility of theft if the handbag is accidentally left unattended. In the same vein, the disclosed location of the support mechanism—between the cabinet and the player—can help to minimize pickpocketing or theft that may result from personal belongings that would otherwise be placed out of the player's immediate line of sight.

Figure 5:
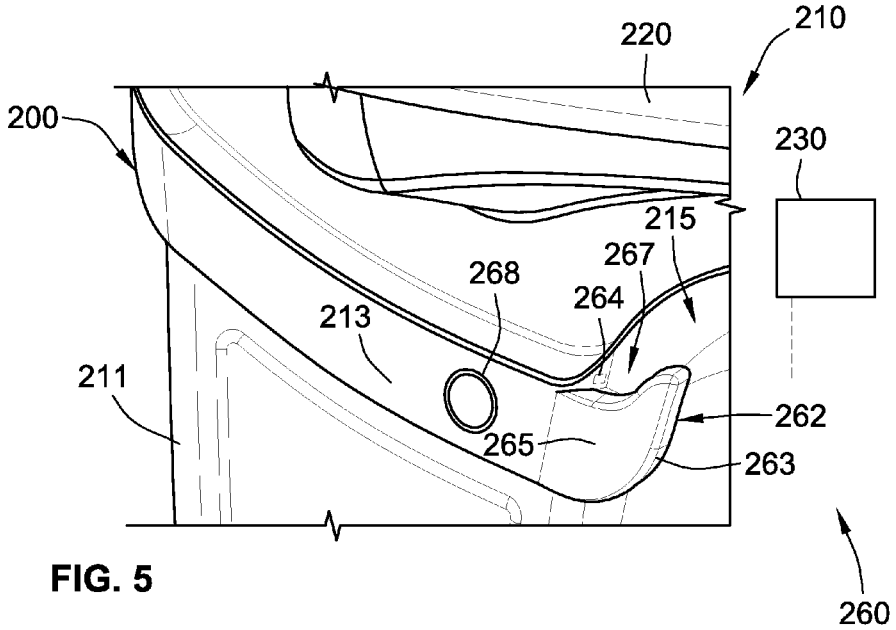
FIG. 5 is a partially schematic perspective-view illustration of a portion of a representative gaming terminal with another utility hook and alert mechanism in accordance with aspects of the present disclosure.

Turning next to FIG. 5, there is shown a representative gaming terminal 200 (or "gaming machine") as part of a gaming system 210 in accordance with aspects of the present disclosure. Like the gaming terminal 100 and gaming system 110 of FIG. 4, the gaming terminal 200 and gaming system 210 of FIG. 5 can take on many of the various forms, optional configurations, and functional alternatives described above with respect to the gaming terminals and gaming systems exemplified in FIGS. 1 and 2, and thus can include any of the corresponding options and features. In this regard, unless otherwise explicitly disclaimed or physically restricted, the gaming terminal 200 and gaming system 210 of FIG. 5 may also comprise any of the optional configurations and functional alternatives described above with respect to the gaming terminal 100 and gaming system 110 of FIG. 4.

The gaming terminal 200 includes a cabinet 211 that may house various input devices, output devices, and input/output devices. The output device(s) may be in the nature of one or more display devices (e.g., primary display 12 and secondary display 14 of FIG. 1), each of which is configured to display aspects of a wagering game, as well as one or more acoustic speakers (e.g., speakers 16 of FIG. 1) to provide complementary audio content. The input device(s) may be in the nature of a button panel 220 and/or a touch screen (e.g., touch screen 18 of FIG. 1), each of which configured to receive inputs from a player to play the wagering game. The gaming terminal 200 of FIG. 5 is also provided with a support mechanism, which is represented herein by a utility hook 262, and an alert system 260, which is exemplified by one or more sensors 264 and 268 that are communicatively coupled to a processor 230. Like the processor 130 of FIG. 4, the processor 230 of FIG. 4 may take on various forms and configurations, including those discussed above with respect to the CPU 30 of FIG. 2.

The utility hook 262 is attached to the cabinet 200 and configured to support one or more personal belongings of the player. As shown, the utility hook 262 of FIG. 5 is cantilevered by the cabinet 211, projecting transversely from a forward portion of the cabinet 211 (e.g., a front facia 213) underneath the button panel 220 and, in some embodiments, proximate a knee well 215. The utility hook 262 of FIG. 5 includes a generally flat, horn-shaped body 263 with a front face 265 that can be contoured to coincide with the contour of the front facia 213 from which it projects. A recessed cavity 267 is located along the upper surface of the horn-shaped body 263. The recessed cavity 267 is shaped and sized, in at least some embodiments, to receive and nest a multitude of different purse and bag straps, coat and sweater locker loops, etc. In that regard, it is also desirable, in at least some embodiments, to fabricate the utility hook 262 from a material of sufficient strength and resiliency to support the player's personal belongings.

The utility hook 262 of FIG. 5 may be rigidly attached to the cabinet 211 or, similar to the embodiment of FIG. 4, may be configured to selectively transition between an extended position, whereat the hook 262 projects from the cabinet 211, and a retracted position, whereat the hook 262 is disposed at least partially inside and/or lies flush against the gaming cabinet 211. The utility hook 262 of FIG. 5 can be pivotally attached to the cabinet 211, for example, to fold from the extended position to the retracted position, and unfold back. The gaming terminal 200 may include a biasing member, such as a torsional spring, to push, pull or otherwise urge the utility hook 262 toward the extended position. A locking mechanism, such as a spring-biased locking tab, can be engaged to lock the utility hook 262 in the retracted position. A release mechanism, such as a release button, may also be provided to release the locking mechanism such that the utility hook 262 is biased to the extended position via the biasing member. For some optional configurations, the movement of the utility hook 262 may be automated.

Similar to the alert system 160 of FIG. 4, the alert system 260 is designed to detect the presence or absence of the player's personal belonging(s) and/or the player at the gaming terminal, and generate an alert signal in response to the detected presence or absence. In some embodiments, the alert system 260: detects the presence and/or absence of a personal belonging hanging on the utility hook 262; detects the presence and/or absence of the player at the gaming terminal 200; and, generates an alert signal in response to a detected presence of the personal belonging and a detected absence of the player. The alert system 260 of FIG. 5, for example, includes two sensors: a first sensor 264 that is operable to detect the presence or absence of a personal belonging hanging on the utility hook 262, and output a signal indicative thereof; and, a second sensor 268 that is operable to detect the presence or absence of the player at the gaming terminal, and output a signal indicative thereof. In the illustrated embodiment, the first sensor 264 is an optical transducer, such as a photodetector, that is housed within the terminal's cabinet 211 and operable to generate a signal responsive of a physical obstruction proximate the cavity 267 of the utility hook 262. Comparatively, the second sensor 268 is a thermal transducer, such as an infrared sensor, that is housed within the cabinet 211 and operable to generate a signal responsive to infrared radiation generated by the player's body in front of the gaming terminal 200. Like the sensors 164, 168 portrayed in FIG. 4, the sensors 264, 268 of FIG. 5 may take on alternative forms and can be packaged in alternate locations. Moreover, the alert system 260 can omit one or more of the sensors 264, 268.

Prior to, contemporaneously with, or after the player leaves the gaming terminal 200, the terminal 200 is configured to alert the player if an item is accidentally left hanging on the utility hook 262. Responsive to the alert signal generated by the alert system 260, the controller 230 can generate various outputs from the gaming terminal 200, including any of those outputs identified above or below. For example, the display device(s) may be configured to display a visual alert in response to the alert signal generated by the alert system 260. In addition, or as an optional alternative, the speaker(s) may be configured to generate an audible alert in response to the alert signal generated by the alert system 260. As another option or alternative, the processor 230 may transmit an electronic notification or warning message to the player or an attendant or other personnel of the gaming establishment.

Figure 6:
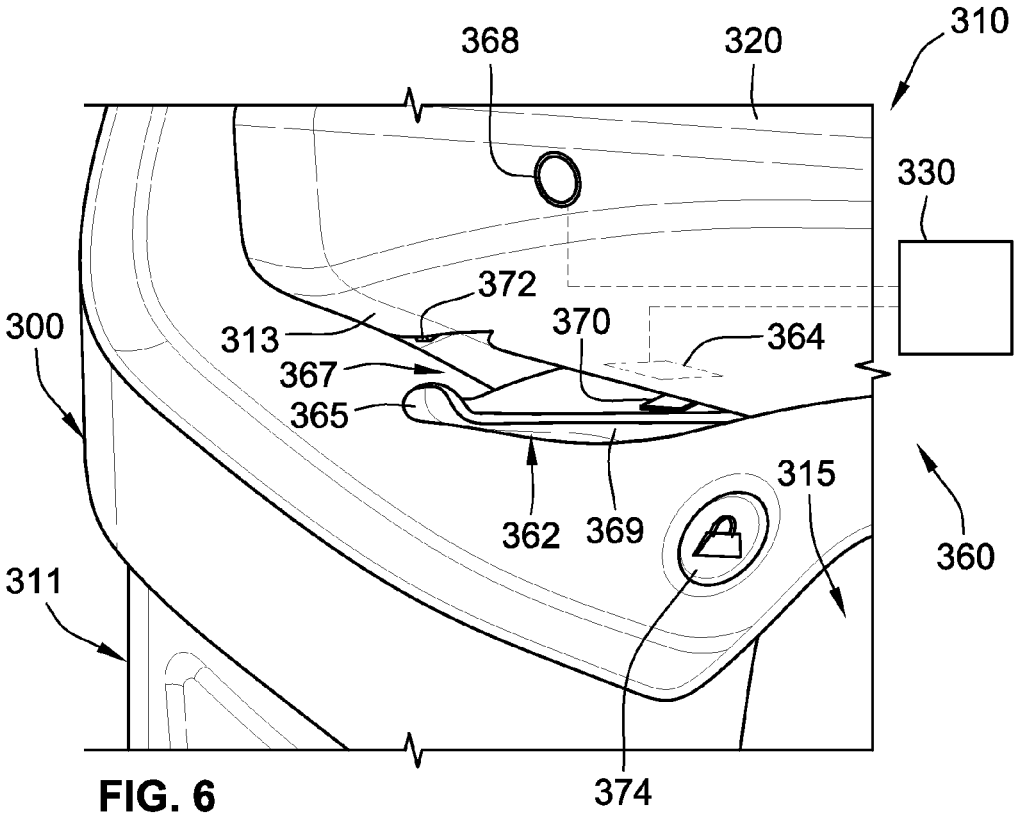
FIG. 6 is a partially schematic perspective-view illustration of a portion of a representative gaming terminal with another utility hook and alert mechanism in accordance with aspects of the present disclosure.

With reference now to FIG. 6, another representative gaming terminal 300 (or "gaming machine"), which is part of a gaming system 310, is presented in accordance with aspects of the present disclosure. Analogous to the gaming terminals and systems of FIGS. 4 and 5, the gaming terminal 300 and gaming system 310 of FIG. 6 can take on many of the various forms, optional configurations, and functional alternatives described above with respect to the gaming terminals and gaming systems exemplified in FIGS. 1 and 2, and thus can include any of the corresponding options and features. In this regard, unless otherwise explicitly disclaimed or physically restricted, the gaming terminal 300 and system 310 of FIG. 6 may also comprise any of the optional configurations and functional alternatives described above with respect to the embodiments of FIGS. 4 and 5.

A gaming terminal cabinet 311 houses various input devices, output devices, and input/output devices, such as display devices (e.g., primary display 12 and secondary display 14 of FIG. 1) to display aspects of a wagering game, acoustic speakers (e.g., speakers 16 of FIG. 1) to provide audio content, a button panel 320 and/or a touch screen (e.g., touch screen 18 of FIG. 1) to receive inputs from a player. Like the terminals 100 and 200 of FIGS. 4 and 5, respectively, the gaming terminal 300 of FIG. 6 is also provided with a support mechanism, which is represented herein by a utility hook 362, and an alert system 360, which is exemplified by one or more sensors 364 and 368 that are communicatively coupled to a processor 330. Like the processor 330 of FIG. 4, the processor 330 of FIG. 6 may take on various forms and configurations, including those discussed above with respect to the CPU 30 of FIG. 2.

The utility hook 362 is attached to the cabinet 200 and configured to support one or more personal belongings of the player. The utility hook 362 of FIG. 6 is pivotally mounted to the cabinet 211, projecting outwardly from a forward portion of the cabinet 311, for example, from underneath the button panel 320 and, in some embodiments, above a knee well 315. The utility hook 362 includes an elongated body 363 with an upwardly flared tip 365 at a distal end thereof. A bottom face 369 of the utility hook 362 can be contoured to coincide with the contour of the underside surface 313 of the button panel 320 such that the utility hook 362, when in a retracted position, lies flush with the underside surface 313. A recessed cavity 367 is located along the upper surface of the elongated body 363. The recessed cavity 367 is shaped and sized, in at least some embodiments, to receive and nest a multitude of different purse and bag straps, coat and sweater locker loops, etc. In that regard, it is also desirable, in at least some embodiments, to fabricate the utility hook 362 from a material of sufficient strength and resiliency to support the player's personal belongings.

The utility hook 362 of FIG. 6 is configured to selectively transition between an extended position, whereat the hook 362 projects from the cabinet 311 downward from the button panel 320, and a retracted position, whereat the hook 362 is at least partially disposed inside the gaming cabinet 311 and lies flush with the button panel 320. The utility hook 362 of FIG. 6 can be pivotally attached to the cabinet 311 to rotate back and for the between the extended and retracted positions. The gaming terminal 300 may include a biasing member, such as a leaf spring 370, to push or otherwise urge the utility hook 362 toward the extended position. A locking mechanism, such as a spring-biased locking tab 372, can be engaged to lock the utility hook 362 in the refracted position. A release mechanism, such as a release button 374, may also be provided to release the locking mechanism such that the utility hook 362 is biased to the extended position via the leaf spring 370. For some optional configurations, the movement of the utility hook 362 may be automated.

Similar to the alert systems 160 and 260 of FIGS. 4 and 5, the alert system 360 is designed to detect the presence or absence of the player's personal belonging(s) and/or the player at the gaming terminal, and generate an alert signal in response to the detected presence or absence. In some embodiments, the alert system 360: detects the presence and/or absence of a personal belonging hanging on the utility hook 362; detects the presence and/or absence of the player at the gaming terminal 300; and, generates an alert signal in response to a detected presence of the personal belonging and a detected absence of the player. The alert system 360 of FIG. 6, for example, includes two sensors: a first sensor 364 that is operable to detect the presence or absence of a personal belonging hanging on the utility hook 362, and output a signal indicative thereof; and, a second sensor 368 that is operable to detect the presence or absence of the player at the gaming terminal, and output a signal indicative thereof. In the illustrated embodiment, the first sensor 364 is a position sensor, such as a linear position transducer, that is housed within the button panel 320 and operable to generate a signal responsive to a displacement of the utility hook 362 which is caused by a personal belonging. Comparatively, the second sensor 368 is an acoustic sensor, such as an ultrasonic transducer, that is housed within the button panel 320 and operable to generate a signal responsive to a physical obstruction (e.g., a portion of the player's body) in front of the gaming terminal 300. Like the sensors of FIGS. 4 and 5, the sensors 364, 368 of FIG. 6 may take on alternative forms and can be packaged in alternate locations. Moreover, the alert system 360 can omit one or more of the sensors 364, 368.

Prior to, contemporaneously with, or after the player leaves the gaming terminal 300, the terminal 300 is configured to alert the player if an item is accidentally left hanging on the utility hook 362. Responsive to the alert signal generated by the alert system 360, the controller 330 can generate various outputs from the gaming terminal 300, including any of those outputs identified above or below. For example, the display device(s) may be configured to display a visual alert in response to the alert signal generated by the alert system 360. In addition, or as an optional alternative, the speaker(s) may be configured to generate an audible alert in response to the alert signal generated by the alert system 360. As another option or alternative, the processor 230 may transmit an electronic notification or warning message to the player or an attendant or other personnel of the gaming establishment.

In accordance with another embodiment of the disclosed concepts, a gaming terminal could include a utility hook comprising a weighted lever that is pivotally mounted on a vertical or substantially vertical surface of the cabinet. In some embodiments, the weighted lever of the utility hook is an elongated body that is rotatably mounted to the cabinet via a hinge or other pivoting attachment mechanism located between the distal ends of the elongated body. The bottom end of the weighted lever, below the pivot point of the elongated body, is weighted such that a player can push on the lower portion of the weighted lever, below the pivot point, to cause the top of the weighted lever to protrude from the cabinet. In at least some embodiments, removal of the player's purse or other personal belonging would cause the hook to automatically return to a retracted position flush with the cabinet. A cherry-type switch or other sensor device is incorporated to determine if the hook is open, and in use, or stowed, and not in use.

While many representative embodiments and exemplary modes for carrying out the present invention have been described in detail above, those familiar with the art to which this invention relates will recognize various alternative designs and embodiments for practicing the invention within the scope of the appended claims.

What is claimed is:

1. A gaming terminal primarily dedicated to playing a wagering game, the gaming terminal comprising:
- at least one cabinet configured to house electronic components operable for conducting the wagering game;
- at least one electronic display device attached to the cabinet and configured to display aspects of the wagering game including randomly determined wagering game outcomes;
- at least one electronic input device attached to the cabinet and configured to receive a physical input indicative of a wager from a player to play the wagering game and transform the physical input into an electronic data signal;
- at least one electronic random element generator configured to generate one or more random elements associated with determining the randomly determined outcomes of the wagering game;
- a support mechanism attached to the cabinet and configured to support a personal belonging of the player; and
- an alert system comprising:
  - a first sensor operable to detect a presence or an absence, or both, of the personal belonging on the support mechanism and output a signal indicative thereof to at least one processor,
  - a second sensor operable to detect a presence or an absence or an anticipated absence of the player, or any combination thereof, at the gaming terminal and output a signal indicative thereof to the at least one processor, and
  - the at least one processor configured to generate an alert signal in response to the detected presence of the personal belonging and the detected absence or anticipated absence of the player, the alert signal including a command to output an audible alert or a visual alert, or both, to the player.

2. The gaming terminal of claim 1, wherein the at least one display device is further configured to display the visual alert in response to the command of the alert signal generated by the alert system.

3. The gaming terminal of claim 1, further comprising one or more speakers configured to generate the audible alert in response to the command of the alert signal generated by the alert system.

4. The gaming terminal of claim 1, wherein the support mechanism comprises a hook configured to selectively transition between an extended position, whereat the hook projects from the cabinet, and a retracted position, whereat the hook is at least substantially inside the cabinet or flush with the cabinet, or both.

5. The gaming terminal of claim 4, wherein the hook is configured to pivot from the extended position to the retracted position.

6. The gaming terminal of claim 4, wherein the hook is configured to translate rectilinearly from the extended position to the refracted position.

7. The gaming terminal of claim 4, further comprising a biasing member biasing the hook toward the extended position.

8. The gaming terminal of claim 4, further comprising a locking mechanism configured to lock the hook in the retracted position, and a release mechanism configured to release the locking mechanism such that the hook is biased to the extended position via a biasing member.

9. The gaming terminal of claim 1, further comprising a lighting mechanism configured to illuminate the support mechanism.

10. The gaming terminal of claim 1, further comprising a button panel projecting from a forward portion of the cabinet, wherein the support mechanism projects from the forward portion of the cabinet underneath the button panel.

11. The gaming terminal of claim 1, wherein the at least one processor of the alert system generates the alert signal in response to the detected presence of the personal belonging by the first sensor and the anticipated absence of the player including a determination by the at least one processor that the player is finished playing the wagering game.

12. A gaming machine comprising:

a cabinet;

an electronic input device operatively connected to the cabinet and configured to receive a physical input from a player to play a wagering game and generate an electronic data signal indicative of the input;

a processor operatively connected to the cabinet and configured to initiate the wagering game in response to the electronic data signal generated by the electronic input device in response to the physical input from the player;

an electronic display device operatively connected to the cabinet and configured to display a randomly determined outcome of the wagering game;

a retractable hook projecting from the cabinet and configured to support a personal belonging of a player, the retractable hook configured to pivot or translate rectilinearly from a retracted position to an extended position whereat the hook projects from the cabinet;

an alert system sensor operatively connected to the cabinet; and an alert system processor configured to:

determine, based at least in part on a signal received from the alert system sensor, a presence or an absence, or both, of the personal belonging hanging on the hook;

determine a presence or an absence or an anticipated absence, or any combination thereof, of the player at the gaming machine; and generate an alert signal in response to a detected presence of the personal belonging and a detected absence or anticipated absence of the player.

13. A gaming system for playing a wagering game, the gaming system comprising:

one or more cabinets configured to house electronic components operable for conducting the wagering game;

one or more electronic input devices coupled to at least one of the one or more cabinets and configured to receive physical inputs from players and transform the physical inputs into electronic data signals;

one or more electronic display devices coupled to at least one of the one or more cabinets and operable to display aspects of the wagering game;

one or more electronic random element generators configured to generate one or more random elements associated with play of the wagering game;

one or more processors operable to execute instructions to:

initiate the wagering game in response to an electronic data signal generated by at least one of the one or more electronic input devices in response to a physical input from a player;

determine an outcome of the wagering game based, at least in part, a random element generated by at least one of the one or more electronic random element generators;

direct at least one of the one or more electronic display devices to display a randomly determined outcome of the wagering game;

a support mechanism attached to the cabinet and configured to support a personal belonging of the player; and an alert system comprising at least one of the one or more processors, a first sensor configured to detect a presence of the personal belonging on the support mechanism, and a second sensor configured to detect an anticipated absence of the player from the gaming terminal, wherein the alert system generates an alert signal in response to the detected presence of the personal belonging and the detected anticipated absence of the player, the alert signal including a command to output an audible alert or a visual alert, or both, to the player.

14. The gaming system of claim 13, wherein at least one of the one or more processors, in response to the alert signal generated by the alert system, is configured to transmit a warning message to an attendant.

15. The gaming system of claim 13, further comprising a speaker, wherein at least one of the one or more processors, in response to the alert signal generated by the alert system, is configured to direct at least one of the one or more display devices to display the visual alert or direct the speaker to generate the audible alert, or both.

16. The gaming system of claim 13, wherein at least one of the one or more processors, in response to the alert signal generated by the alert system and a determination that the player is finished playing the wagering game, outputs a warning notification.

17. The gaming system of claim 13, wherein the support mechanism comprises a hook configured to selectively transition between an extended position, whereat the hook projects from the cabinet, and a refracted position, whereat the hook is disposed at least substantially inside the cabinet or flush with the cabinet, or both.

18. The gaming system of claim 17, further comprising:

a biasing member biasing the hook toward the extended position;

a locking mechanism configured to lock the hook in the retracted position; and a release mechanism configured to release the locking mechanism such that the hook is biased to the extended position via the biasing member.

19. The gaming terminal of claim 1, wherein the at least one processor includes a gaming processor operable for initiating the wagering game and an alert system processor operable for generating the alert signal.

20. The gaming terminal of claim 1, wherein the at least one processor is mounted inside the cabinet.

21. The gaming terminal of claim 1, wherein the support mechanism comprises a hook.

22. A gaming system comprising:

an electronic gaming machine primarily dedicated to conducting a wagering game, the electronic gaming machine including a cabinet, one or more electronic input devices coupled to the cabinet, one or more electronic display devices coupled to the cabinet and operable to display aspects of the wagering game, one or more sensors mounted to the cabinet, and a retractable hook coupled to the cabinet and configured to pivot or translate rectilinearly from a retracted position, at least partially inside the cabinet, to an extended position, at least partially projecting from the cabinet;

one or more processors; and one or more memory devices storing instructions which, when executed by at least one of the one or more processors, cause the electronic gaming machine to:

initiate, via at least one of the one or more processors, the wagering game in response to a wager input from a player;

determine, via at least one of the one or more processors, an outcome of the wagering game;

display, via at least one of the one or more electronic display devices, the outcome of the wagering game;

detect, via at least one of the one or more sensors, a presence or an absence, or both, of at least one personal belonging hanging on retractable hook;

detect a presence or an absence, or both, of the player at the gaming machine, the detected absence of the player including an indication that the player is about to leave or leaving or left the gaming machine; and generate an alert signal in response to a detected presence of the personal belonging and a detected absence of the player.

* * * * *